United States Patent [19]

Hasegawa et al.

[11] 4,434,611

[45] Mar. 6, 1984

[54] PNEUMATIC TWISTING SPINNING APPARATUS

[75] Inventors: Junzo Hasegawa, Obu; Susumu Kawabata, Aichi; Hiroshi Niimi, Nagoya, all of Japan

[73] Assignee: Kabushiki Kaisha Toyota Chuo Kenkyusho, Aichi, Japan

[21] Appl. No.: 341,113

[22] Filed: Jan. 20, 1982

[30] Foreign Application Priority Data

Jan. 31, 1981 [JP] Japan ..... 56-13319

[51] Int. Cl.[3] ..... D01H 5/28; D01H 5/18

[52] U.S. Cl. ..... 57/328; 57/293; 57/333

[58] Field of Search ..... 57/293, 294, 315, 328, 57/333; 19/236, 248, 258, 259, 286–288

[56] References Cited

U.S. PATENT DOCUMENTS 2,853,847 9/1958 Keeler et al. ..... 57/328

4,183,202 1/1980 Morihashi ..... 57/328

4,351,146 9/1982 Faure et al. ..... 57/293 X

*Primary Examiner*—John Petrakes

*Attorney, Agent, or Firm*—Oblon, Fisher, Spivak, McClelland & Maier

[57] ABSTRACT

The present invention relates to a pneumatic twisting spinning apparatus comprising a drafting device for forming a fleece, a deflection roller, a pneumatic twisting nozzle for injecting air into a twisting tube to form a swirling air stream, so that the fleece can be twisted into a yarn, a take-up roller for withdrawing the yarn, and a winding roller. The deflection roller is disposed adjacent to the front roller, for varying the direction of fleece travel and supplying the fleece along an outer peripheral wall of said front roller, and separating ends of peripheral fibers from the fleece as free fibers, which will be twisted by the pneumatic twisting nozzle so as to be wound around central main fibers, thereby forming a bundled yarn.

11 Claims, 10 Drawing Figures

PNEUMATIC TWISTING SPINNING APPARATUS

BACKGROUND OF THE INVENTION

1. Field of the Invention:

The present invention relates to a pneumatic twisting spinning apparatus for producing high-quality spun yarn as of natural and synthetic fibers stably at a high speed with a low power requirement.

2. Description of the Prior Art:

Typical known spinning apparatus include ring spinning frames and open-end spinning machines.

The ring spinning frames have found versatile use as it can produce a wide variety of yarns of from low to high yarn number counts. However since they utilize a revolving package, the spinning speed is on the order of 20 m/min., which will be difficult to increase markedly in the future.

The open-end spinning machines, which have been developed recently, are more productive since they operate at speeds two or three times higher than those of the ring spinning frames. The open-end spinning machines, however, are used mainly for forming coarse yarns for the reason that if fine yarns were to be produced on the machines, fibers would be bent into hooks and loops on the yarn formed.

Various bundled-yarn spinning apparatus or pneumatic twisting spinning apparatus have been proposed for producing bundled yarns in which peripheral fibers are wound around central fibers that are substantially untwisted.

The basic principles of such pneumatic twisting spinning apparatus or bundled-yarn spinning apparatus will be described with reference to FIG. 1.

Staple fibers, such as natural and synthetic fibers, known as sliver SL or roving are supplied to a drafting device D in which staple fibers supplied are drafted several ten or hundred times into a bundle S of fibers, or fleece, having a thickness equal to that of a yarn to be produced.

A false twister K rotates the fleece about its own axis until it is twisted. The fleece S as it leaves a front roller assembly FR is twisted by rotation of the false twister K. The false twister K may rotate in a righthand or lefthand direction, and the fleece shown in FIG. 1 is given a Z twist upstream of the false twister K. In FIG. 2(A), assuming that the fleece travels at a speed of v upstream of the false twister K and the false twister K rotates at a speed of n, the fleece is given a twist of n/v. As the fleece goes past the false twister K, or at a position downstream of the false twister K, the fleece is given an S twist which is opposite to and hence untwists the Z twist given upstream of the false twister K. Since the false twister K rotates at the same speed as that of travel of the fleece, the fleece becomes completely untwisted when it reaches a winding roller MR, and no yarn is produced.

In FIG. 2(B), the fleece S as it emerges from the front roller assembly FR is subjected to an apron or an air stream so that the fleece will not wholly be twisted by the false twister K. Central fibers (hereinafter referred to as "main fibers") of the fleece are twisted by the false twister K in a manner described above. Peripheral fibers (hereinafter referred to as "free fibers") remote from the center of the fleece are not twisted for a while after the fleece has left the front roller assembly FR, and start being twisted when they become attached to the main fibers as the fleece approaches the false twister K.

Therefore, the free fibers as they are located upstream of the false twister K are given a twist of dn/v ($0<d<1$) which is smaller than the twist of n/v given to the main fibers. As the fleece thus twisted moves through the false twister K, it is rotated in a direction to have an S twist which is opposite to a Z twist. The twist given upstream of the false twister K is thus gradually untwisted. Between the false twister K and take-up and winding rollers TR, MR, the fleece is given an opposite twist of n/v. The main fibers have no twist as the twist given upstream of the false twister is offset by the twist applied downstream of the false twister. However, the free fibers are given the twist of dn/v upstream of the false twister and the twist of n/v downward of the false twister, where $dn<n$, a twist of n-dn/v is left in the free fibers. A yarn T produced by a pneumatic twisting spinning apparatus retains its strength due to such twisted free fibers.

Known pneumatic twisting spinning apparatus are disadvantageous in that many yarn breakages occur during spinning, and a yarn strength required in actual use is unavailable. As the apparatus is operated at higher speeds, the behavior of fleece becomes more unstable and it becomes still more unstable as it is disturbed by an air flow caused by the front roller assembly rotating at a high speed. The shorter and fewer the fibers are, the more unstable the fleece becomes, resulting in a tendency to be broken by a slight disturbance which the fleece is subjected to. The conventional apparatus have thus been limited to use with relatively long fibers and with a relatively low spinning speed, and hence have not practically been usable.

Proposals have been made to give bundled yarns an increased strength which the aforesaid apparatus have failed to provide.

One such proposal is to spread and distribute a fleece as it is discharged from a drafting machine. Since this merely serves to produce free fibers, it is only applicable to long fibers in order to form strong yarns stably, and hence is practically unsatisfactory.

Another proposal uses an apron driven by a front roller assembly of a drafting machine. The apron has a poor degree of durability in operation and involves difficulty in maintenance. A recessed roller may be used to grip a fleece softly. It is however quite difficult to provide a suitable degree of softly gripping pressure for producing a bundled yarn of sufficient strength. Such a recessed roller is of little use from the practical standpoint.

SUMMARY OF THE INVENTION

The present invention is based on an understanding that the way in which free fibers are formed in a pneumatic twisting spinning apparatus and the relationship between main and free fibers are important, the understanding being the result of systematic experimentation and theoretical analysis which the present inventors have conducted in an effort to eliminate the problems experienced with conventional pneumatic twisting spinning apparatus.

It is an object of the present invention to overcome the problems with known pneumatic twisting spinning apparatus and to provide a pneumatic twisting spinning apparatus for producing high-quality spun yarn having a high strength from natural and synthetic fibers stably at high speeds with a low power requirement.

Another object of the present invention is to provide a pneumatic twisting spinning apparatus which is durable, requires easy maintenance, and is highly practically feasible.

A pneumatic twisting spinning apparatus according to the present invention comprises a drafting device having a front roller and back roller for opening fibers and forming a bundled fibers having a predetermined thickness, a deflection means, disposed adjacent to said front roller, for varying the direction of fleece travel and supplying the fleece along an outer peripheral wall of said front roller, a pneumatic twisting nozzle for injecting air under high pressure into a twisting tube to form a swirling air stream having an axial component of force, so that the fleece supplied from the deflection means can be twisted into a yarn by the swirling air stream revolving at a high speed, a take-up roller for withdrawing the yarn from the pneumatic twisting nozzle, and a winding roller for winding the yarn as it is withdrawn by the take-up roller, the arrangement being that the fleece will be supplied along the outer peripheral walls of the front roller and the deflection means in a varied direction of travel to separate ends of peripheral fibers from the fleece as free fibers, which will be twisted by the pneumatic twisting nozzle so as to be wound around central main fibers, thereby forming a bundled yarn.

BRIEF DESCRIPTION OF THE DRAWINGS

Various other objects, features and advantages of the present invention will be apparent from the following detailed description when considered in connection with the accompanying drawings, in which like reference characters designate like or corresponding parts throughout the several views, and wherein:

FIGS. 1 and 2 are views illustrative of basic principles of conventional apparatus;

FIG. 1 is a view showing the basic arrangement of a prior apparatus;

DETAILED DESCRIPTION

Figure 3:
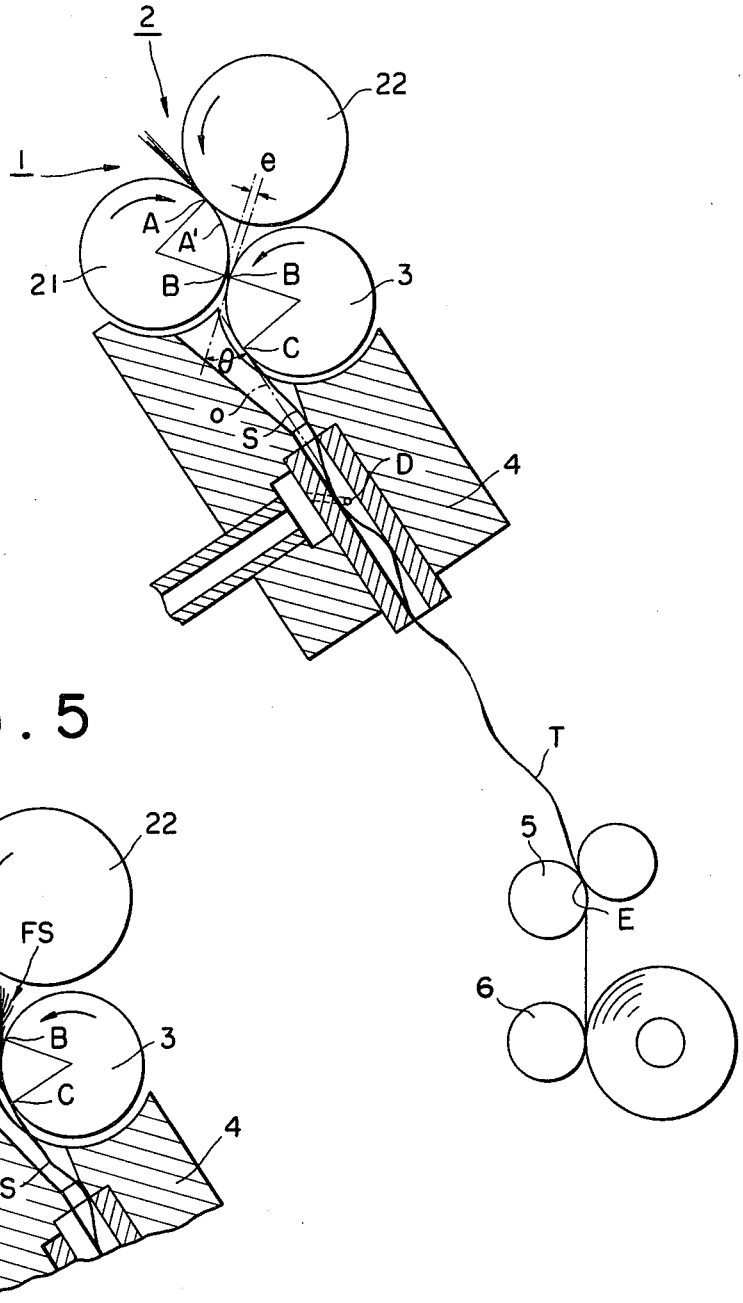
FIG. 3 is a cross-sectional view showing the basic arrangement of an apparatus according to the present invention.

The pneumatic twisting spinning apparatus constructed as above will be described in detail for operation and advantages with reference to FIGS. 3 through 5.

Sliver SL is supplied to a drafting device 1 in which the sliver is formed into a number of fibers having a cross section corresponding to the thickness of a yarn to be produced when it emerges from a front roller assembly 2. The fibers, or a fleece S, moves in a direction tangential to a front top roller 22 and a front bottom roller 21. The fleece S changes its direction of movement due to a deflection roller 3 as a deflection means, so that the fleece S will travel along a curved surface on the outer peripheral wall of the front bottom roller 21, which is defined between points A and B. The deflection roller 3 is spaced from the front bottom roller 21 with a clearance e larger than the thickness of the fleece S so as not to hold the latter firmly.

The fleece S moves through the clearance e and is sucked into a pneumatic twisting nozzle 4. The fleece S first travels in a direction normal to a line extending through the centers of the front bottom roller 21 and the deflection roller 3, and then changes its course so as to travel along a curved surface on the outer peripheral wall of the deflection roller 3 since there is an angle $\theta$ formed between the direction normal to the line between the roller centers and a central axis O of the pneumatic twisting nozzle 4.

The fleece S as it is supplied from the deflection roller 3 into the pneumatic twisting nozzle 4 is rotated on its own axis and twisted by a swirling air stream in the pneumatic twisting nozzle 4. The fleece is rotated such that it will be given a Z twist upstream of a twisting point D and also given an S twist downstream of the point D. The basic principles of yarn formation are the same as those described above with reference to the conventional pneumatic twisting spinning apparatus, and hence will not be repeated.

The deflection roller 3 provided in accordance with the present invention will be described for operation and advantages.

The deflection roller 3 is disposed in the vicinity of the front roller assembly 2 to control transmission of twists given by the pneumatic twisting nozzle 4. The fleece S as it tends to progress tangentially is forced by the deflection roller 3 to be supplied along the curved surface on the outer peripheral wall of the front bottom roller 21, causing the fleece S to be subjected to centrifugal forces. Such centrifugal forces, the inertia tending to force the fleece to move tangentially, and the rigidity of the fibers jointly cause ends of fibers located peripherally around the fleece S and having the other ends retained in the fleece S as it is twisted in the pneumatic twisting nozzle, to come off the fleece S as untwisted free fibers FS, as shown in FIG. 5.

The fleece S as it leaves the front bottom roller 21 is forcibly fed along the curved surface of the outer peripheral wall of the deflection roller 3, whereupon more free fibers FS that are untwisted are formed in the same manner as described above as illustrated in FIG. 5.

The fleece having, as peripheral fibers, free fibers thus formed on the front bottom roller 21 and the deflection roller 3 is subjected to a swirling air flow under high pressure in the pneumatic twisting nozzle 4, wherein the twisted central main fibers are given an opposite twist or get untwisted downstream of the twisting point, and the untwisted peripheral free fibers get twisted so as to be wound around the main fibers now untwisted, thus forming a bundled yarn T.

The bundled yarn T thus produced is taken up by a take-up roller 5 and wound around a winding roller 6.

With the pneumatic twisting spinning apparatus according to the present invention, the deflection roller 3 is disposed in the vicinity of the front roller assembly with the slight clearance e to cause the fleece S to be held against the curved surfaces of the front roller assembly 2 and the deflection roller 3 across the clearance e. Such an arrangement prevents ballooning which would otherwise be formed on the fleece due to twists given by the pneumatic twisting nozzle 4 and which would prevent formation of free fibers that are important for bundled yarn, and hence assists in producing free fibers. More specifically, known apparatus have had an apron or skirt, or formed an angle between a direction tangential to a front roller and an axis of a pneumatic twisting nozzle, for producing free fibers. However, a fleece is subjected to ballooning of a short pitch which allows twists to be transmitted and hence prevents free fibers from being produced. The apparatus according to the present invention is designed to prevent ballooning from being generated, limit twist transmission, and assist in formation of free fibers.

The deflection roller 3 also serves to change the direction of movement of the fleece at both nipping point A and at point B, thus causing the fleece to be held continuously against two curved surfaces AB and BC.

Since the deflection roller 3 thus serves to bring the fleece S into continuous contact with the curved surfaces AB and BC, twists become gradually smaller as they are transmitted from the pneumatic twisting nozzle 4 through the points C, B and to the point A. The curved surface AB is convex and the curved surface BC is concave to the fleece, so that the contact surfaces have continuously varying shapes on opposite sides of the point B in the clearance. Therefore, in the vicinity of the point B, which is located between the two points where the fleece changes its direction, prevents the transmission of twists to a large extent due to the varied shapes of the fleece. The deflection roller 3 thus serves to limit the transmission of twists to the fleece, and the twist distribution between the points A and D is reduced stepwise from the zones DC to CB to BA.

Figure 1:
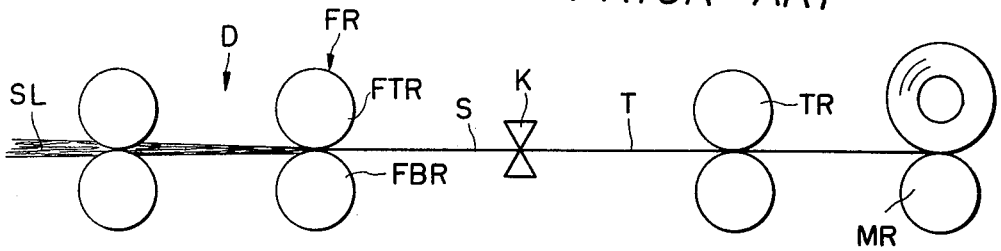
FIG. 1 PRIOR ART
Figure 2A:
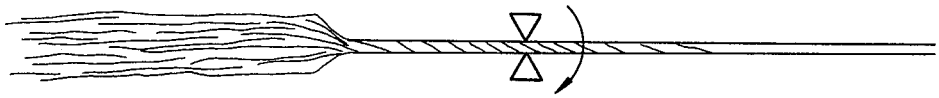
FIG. 2(A) PRIOR ART
FIGS. 2(A) and 2(B) being illustrative a fleece and a yarn formed by conventional apparatus.
Figure 2B:
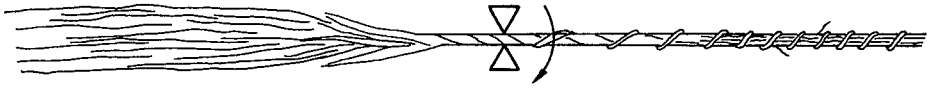
FIG. 2(B) PRIOR ART
Figure 4:
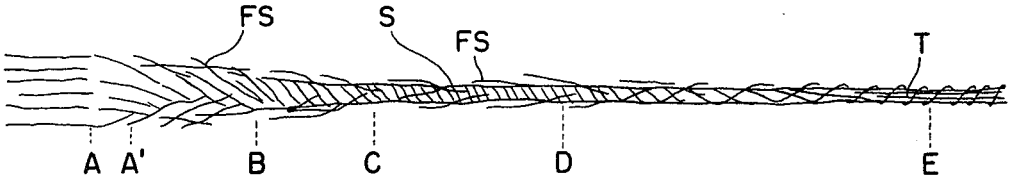
FIG. 4 is a view showing a fleece and a yarn produced by the apparatus of the present invention.
Figure 5:
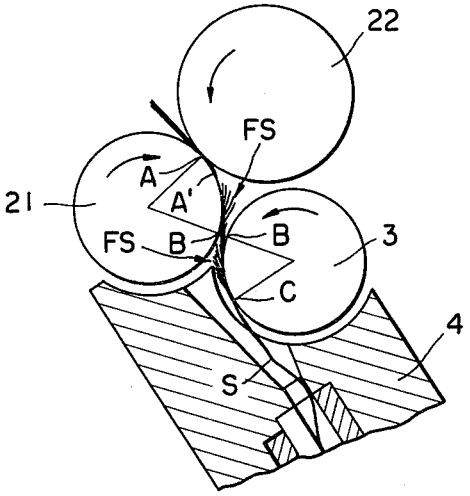
FIG. 5 is a cross-sectional view illustrative of the way in which free fibers are formed.

Such a reduction in the twists is illustrated in FIG. 4. The fleece is given a Z twist upstream of a point D in the pneumatic twisting nozzle. After the fleece has moved through the section C-D, it is given twists n/v per unit length. Upon movement through the section B-C, the fleece is given twists jn/v ($0<j<1$). As the fleece has moved beyond the section A'-B, the fleece is given twists kn/v($0<k<j$). The point A' is close to the nipping point A. Right after fibers have moved past the point A, they are given no twists, and hence no twist is given to the fibers between the points A and A'. The number of twists given to the fibers are thus changed stepwise between the points A and D by the deflection roller 3.

The present invention positively permits changes in the number of twists for effective formation of free fibers, which are wound around main fibers to produce a strong bundled yarn, by positively providing a difference between twisted main and free fibers as described above.

A process of producing a bundled yarn on the apparatus of the present invention will be described in detail with reference to FIG. 4.

The fibers are held against the curved surface of the front bottom roller between the points A and B. When the leading ends of the fibers reach the point B as shown in FIG. 5, some fibers at the trailing ends tend to separate from the main fibers and hence to move away from the curved surface due to the ridity of the fibers and the change in the direction of travel of the fibers (The leading and trailing ends are not necessarily in conformity with the direction of fibers as they leave the point A, but may be opposite to each other.) The free fibers thus formed have their leading ends tucked in the main fibers with the trailing ends free as shown between the points A' and B in FIG. 4. Such free fibers will be quite effective in strengthening the yarn. To produce as many such free fibers as possible, it is preferable that the fibers between the points A' and B are twisted to a smaller degree to allow the fibers to be put together less firmly. This is achieved by the deflection roller 3 as well as the fiber's being held against the curved surface, as described above, to produce a small twist (kn/v).

The fibers are subjected to the same process between the points B and C as that of between the points A' and B. However, the fibers are given a twist jn/v between the points A and B, which is greater than the twist kn/v given between the points A' and B, and hence are slightly less prone to form free fibers. When the fibers are held against the curved surface between the points B and C, a stronger yarn will be produced.

The main fibers are given a twist (n−jn/v) between the points C and D, and the free fibers are also given a twist (n−jn/v) between these points. Some of the free fibers have already been subjected to a twist (jn−kn)/v between the points B and C. When the fibers move past the point D, the main fibers have the twist n/v and the free fibers have the twists (n−kn)/v and (n−jn)/v.

As the fibers travel past the point D, the fibers are twisted in a direction opposite to the direction in which they have been twisted upstream of the point D, and hence the twist given upstream of the point D starts to be removed. When the fibers reach the position E where there is the take-up roller 5, the main fibers are full untwisted. The free fibers are however given S twists such as $$\frac{n}{v} - \frac{n-kn}{v} = \frac{kn}{v} \text{ and } \frac{n}{v} - \frac{n-jn}{v} = \frac{jn}{v}$$

which are opposite to those applied upstream of the point D. The free fibers thus twisted bind the main fibers, producing a strong yarn which is wound around the winding roller 6.

As described above, the deflection roller 3 is highly advantageous in producing yarns having a sufficient strength and hence of a good quality.

The fibers rotate at considerable speeds on the curved surfaces AB and BC where there are produced fibers having leading ends tucked in the main fibers and trailing ends released free. The fibers having free ends remain twisted due to such rotation after they have gone through the untwisting zone, and are wound strongly around the main fibers. The free fibers therefore have their leading ends serving as part of the main fibers and fastened by the free ends of other fibers, and the trailing ends coiled securely around the main fibers.

With such fibers having leading ends tucked in the main fibers and trailing ends free being produced on the curved surfaces AB and BC, the fibers can be rotated at high speeds by the pneumatic twisting nozzle, and such rotation is utilized effectively to twist the free fibers for producing yarns at an increased rate with a reduced power requirement.

Yarns of a sufficient strength can be formed by producing almost all free ends on the curved surface AB, that is, by producing free trailing ends of fibers when the latter move along the curved surface AB as they rotate at progressively higher speeds. To this end, it is required that the fibers be forcibly pressed against the curved surface AB by the deflection roller 3. The fibers should preferably be pressed against both the curved surfaces AB and BC for forming yarns of a greater strength.

The fibers may not necessarily be held in contact with the curved surface of deflection roller 3. However, contact with the deflection roller 3 allows yarns to be spun stably. More specifically, an air stream jet flows in the air twisting nozzle along the direction of travel of the fibers and hence acts to pull the latter. Thus, the air stream has a potential for breaking the fibers where they are not sufficiently twisted on the curved surface. With the apparatus according to the present invention, the front roller assembly 2 and the deflection roller 3 define curved surfaces AB and BC serving as two turning points, an arrangement which will lessen a tension as given by the pneumatic twisting nozzle 4 on the fleece disposed on the curved surface AB of the front bottom roller 21, thus preventing the fleece from being broken while being spun and hence allowing yarns to be spun stably and produced at a high rate.

The pneumatic twisting spinning apparatus according to the present invention may be embodied in the following forms to advantage.

According to a first aspect, the length of the outer peripheral wall of the front roller along which the fleece is supplied is at least 5 mm and is less than the length of fibers of the fleece supplied. More specifically, the length $l_{AB}$ for which the fleece S is supplied along the outer peripheral wall of the front roller should meet the following requirement with respect to the length L of fibers of the fleece:

$$5\ \text{mm} < l_{AB} < L, \text{ or } 2\pi rn < l_{AB} < L$$

where r is the radius of the fleece, and n is the number of turns around the main fibers.

According to a second aspect, the length of the outer peripheral wall of the front roller along which the fleece is supplied is at least 1 mm and less than the length of fibers of the fleece supplied. More specifically, the length $l_{BC}$ for which the fleece S is supplied along the outer peripheral wall of the deflection roller 3 should meet the following requirement with respect to the length L of fibers of the fleece:

$$1\ \text{mm} < l_{BC} < L$$

According to a third aspect, the combined length of the outer peripheral walls of the front roller and the deflection roller along which the fleece is supplied is at least 6 mm and less than the length of fibers of the fleece. More specifically, the combined length $l_{AC}$ for which the fleece S is supplied along the outer peripheral walls of the front roller 2 and the deflection roller 3 should meet the following requirement with respect to the length L of fibers of the fleece:

$$6\ \text{mm} < l_{AC} < L$$

With the pneumatic twisting spinning apparatus according to the present invention, the fleece is twisted to a small degree between the points A and A' or at an area adjacent to the point A' between the points A' and B, and such less twisted fleece is held against the curve AB, so that the fleece will have its central fibers twisted by the pneumatic twisting nozzle 4, but peripheral fibers remaining untwisted, the central fibers serving as main fibers and the peripheral fibers as free fibers. The deflection roller 3 is thus effective to produce many free fibers.

In order to produce free fibers effectively, it is important that trailing fiber ends are released free. The length of the trailing fiber ends required to be wound around the main fibers a few times should be $2\pi rn$ where r is the radius of the fleece and n is the number of turns around the main fibers, n being more than 5 or 6. To meet such a condition, the length $l_{AB}$ of the curved surface AB of the front bottom roller should be more than $2\pi rn$. It is preferable that the free trailing ends of the free fibers should in practice be at least 5 mm because if the free fiber ends were too short, they would become feathery due to the rigidity of the fibers.

Since the fibers on the curved surface AB of the front bottom roller 21 are not sufficiently twisted, the length of the curved surface AB should be shorter than that of the fibers to make yarn spinning stable. If a single fiber extends between the points A and B, yarn will be spun stably as the fiber becomes twisted between the points B and C.

The deflection roller 3 also serves to free the trailin ends of fibers which have leading ends tucked in the main fibers. More specifically, the deflection roller 3 causes the fleece from the front roller assembly 2 to change its direction of travel, so that peripheral fibers of the fleece has leading ends caught in the main fibers as they travel along the curved surface BC, and trailing ends are released free of the main fibers, as shown in FIG. 5, due to the rigidity, centrifugal forces and inertia of the fibers as the trailing ends travel out of contact with the curved surface BC. The length $l_{BC}$ for which the fleece is held against the curved surface of the deflection roller 3 should be at least 1 mm and less than the length L of fibers of the fleece. If the length $l_{BC}$ was more than the fiber length L, the difference between the numbers of twists given to the fleece on the points B and C on the curved surface BC of the deflection roller 3 would be large and fail to withstand the tension given, resulting in a breakage of the fleece on the curved surface BC.

Briefly summarized, the combined length $l_{AC}$ of the curved surfaces AB and BC of the front bottom roller 2 and the deflection roller 3 should be at least 6 mm and less than twice the fiber length L for spinning strongly bundled yarns stably at high speeds and hence at high rates of production. Where the total length $l_{AC}$ is less than the fiber length L, the fibers extend entirely between the curved surfaces AB and BC for spinning more strongly bundled yarns stably at high speeds and at high rates of production.

According to the pneumatic twisting and spinning apparatus of the present invention which satisfy the foregoing conditions, the free trailing ends of fibers are caused to rotate on the curved surfaces AB and BC and remain twisted due to such rotation after they have moved past the untwisting zone, thereby fastening main fibers therearound. With the fibers having such free trailing ends, peripheral fibers have leading ends fastened by other fibers to the main fibers and trailing ends fastening other fibers, thus cooperating with each other in spinning stronger yarns stably at high speeds and hence increased rates of production.

The fibers with free trailing ends can be rotated at a high speed by the pneumatic twisting nozzle 4 having an excellent spinning performance. Such fibers can effectively be formed and rotated at a high speed at regions AB and BC where the front bottom roller and the deflection roller are rotated relatively at high speeds. The apparatus as described above has many advantages in that twists can be left effectively, yarns can be produced at high speeds, and the apparatus has a low power requirement since only power for rotating the fleece is needed.

A pneumatic twisting spinning apparatus according to an embodiment of the present invention will be described with reference to FIG. 6 and FIGS. 3 through 5.

Figure 6:
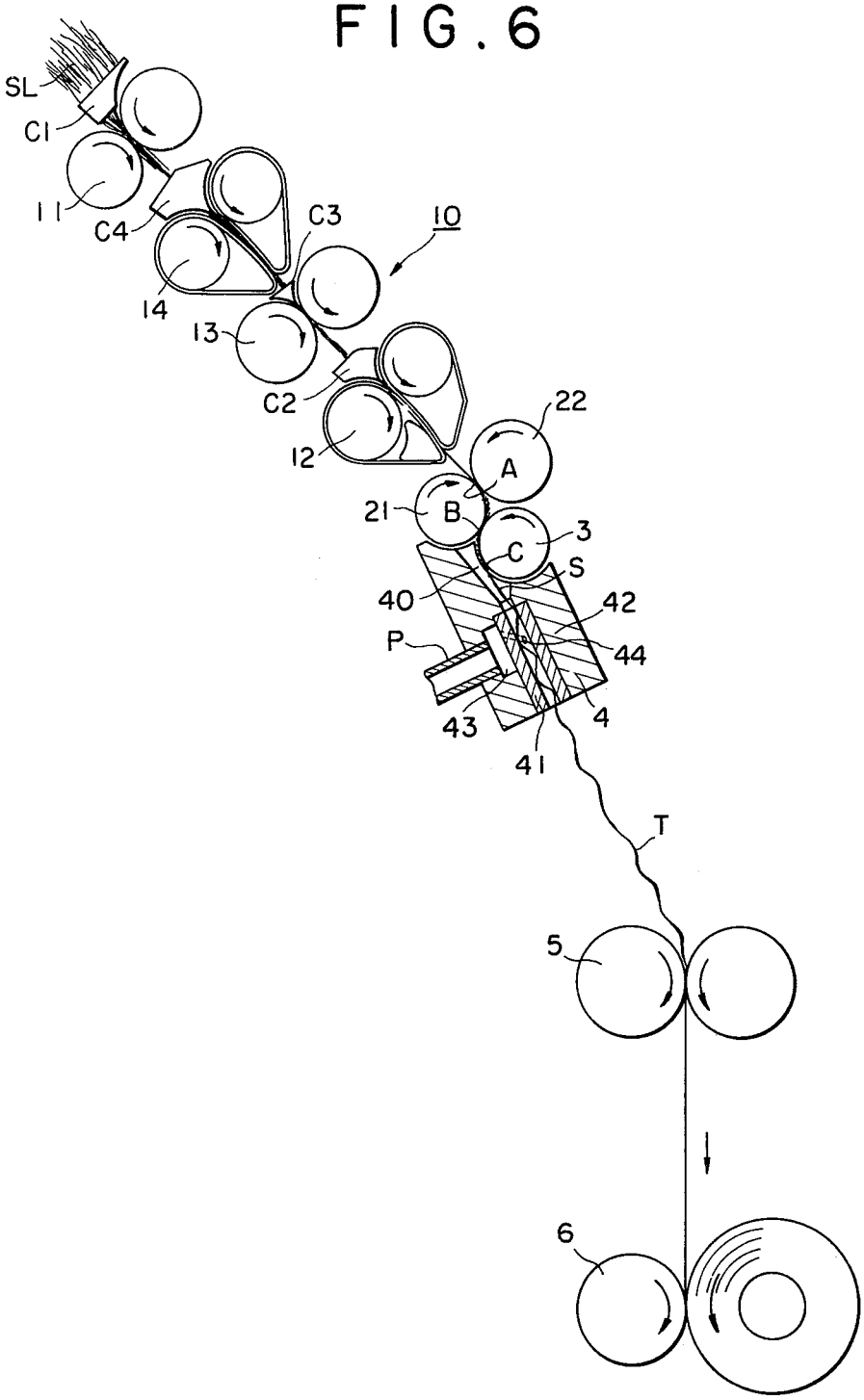
FIG. 6 is a side elevational view of a pneumatic twisting spinning apparatus according to an embodiment of the present invention.

The pneumatic twisting spinning apparatus according to this embodiment serves to spin blended yarn of a yarn number count 45. As shown in FIG. 6, the apparatus includes a fiveline drafting device 10 having five pairs of rollers, the final pair being constituted of a front bottom roller 21 and a front top roller 22, a deflection roller 3 disposed adjacent to the front bottom roller 21 and rotated at a peripheral speed equal to that of the front bottom roller 3, a pneumatic twisting spinning nozzle 4 having an introduction port 40 located adjacent to the deflection roller 3 and the front bottom roller 21 for injecting air under pressure tangentially and axially into a twisting tube 41 communicating with the introduction port 40 to form a swirling air stream having an axial force component for twisting a fleece supplied from the deflection roller 3 with the swirling air stream rotating at a high speed, a take-up roller assembly 5 for withdrawing a yarn out of the twisting tube 41 in the pneumatic twisting nozzle 4, and a winding roller assembly 6 for winding up the yarn from the take-up roller assembly 5.

The drafting device 10 is supplied with sliver SL to form the latter into a fleece S composed of a number of fibers having a cross section equal to the thickness of a yarn to be produced. The drafting device 10 comprises a pair of back rollers 11 with an introduction collector C1 disposed upstream thereof, pairs of fourth rollers 14, third rollers 13, and second rollers 12 spaced predetermined distances from each other with collectors C4, C3, and C2 disposed upstream respectively thereof, and a front roller assembly 2 comprised of the front bottom roller 21 of stainless steel and the front top roller 22 having a rubber covering and pressed forcibly against the front bottom roller 21. These rollers are rotated at progressively higher peripheral speeds from the back rollers 11 toward the front rollers 2. The collectors located upstream respectively of the rollers comprise ordinary sliver collectors having widths which determine the widths of desired fleeces. As the sliver SL is introduced into the introduction collector C1, the sliver SL is drafted gradually as it goes through the back rollers 11, the fourth rollers 14, the third rollers 13, and the second rollers 12 until the sliver SL reaches the front roller pair 2, thus forming a fleece having a predetermined width and arranged in the form of fibers having a cross section equal to the thickness of a yarn to be produced. The sliver SL used is composed of 65% of polyester and 35% of cotton, and its average fiber length L is about 33 mm.

The deflection roller 3 is spaced from the front bottom roller 21 by a clearance e and from the front top roller 22 by a predetermined distance, and has a diameter which is the same as that of the front bottom roller 21. The deflection roller 3 is driven by the front bottom roller 21 through a gear mechanism to rotate in the same direction (shown by the arrow in FIG. 6) and at the same peripheral speed as those of the front bottom roller 21.

In the illustrated embodiment, the diameters of the front bottom roller 21, the front top roller 22 and the deflection roller 3 are respectively 25 mm, 28 mm and 25 mm. The fleece is caused by the deflection roller 3 to travel along a curved surface AB (see FIG. 3) on the outer peripheral wall of the front bottom roller 21, the curved surface AB having a length $l_{AB}$ of about 13 mm ($\approx$0.4 L), and the fleece is also caused to travel along a curved surface BC (see FIG. 3) on the outer peripheral wall of the deflection roller 3, the curved surface BC having a length $l_{BC}$ of about 11 mm ($\approx\frac{1}{3}$ L).

With the deflection roller 3, the fleece S as it leaves the point A on the front bottom roller 21 is supplied along the curved surface AB on the outer peripheral wall of the front bottom roller 21 and then along the curved surface BC on the outer peripheral wall of the deflection roller 3 while moving across the clearance e.

The pneumatic twisting nozzle 4 is located adjacent to the front bottom roller 21 and the deflection roller 3 with the introduction port 40 opening toward the front bottom roller 21 and the deflection roller 3. The twisting tube 41 is mounted in a nozzle body 42 in communication with the introduction port 40. The axis of the introduction port 40 and the twisting tube 41 and the straight line extending normal to the line connecting the centers of the front bottom roller 21 and the deflection roller 3 intersect to form an angle $\theta$. The nozzle body 42 has a communication passage 43 formed therein which communicates with a source of high-pressure air (not shown) through a pipe P. The twisting tube 41 has a through hole 44 defined through a wall of the twisting tube 41 and at an angle to the axial direction of the twisting tube 41. When air under high pressure is supplied from the high-pressure air source through the pipe P, the passage 43 and the hole 44 into the twisting tube 41, there is generated a swirling air stream having an axial force component in the twisting tube 41.

Thus, the pneumatic twisting nozzle 4 applies a swirling air stream revolving at high speeds in the twisting tube 41 to the fleece S supplied from the deflection roller 3, to thereby twist the fleece into a bundled yarn T.

The take-up rollers 5 are spaced a predetermined distance from the pneumatic twisting nozzle 4 and are rotated at a given peripheral speed for taking-up the bundled yarn thus formed out of the pneumatic twisting nozzle 4.

The winding rollers 6 are spaced a predetermined distance from the take-up rollers 5 and are rotated at a given peripheral speed for winding up the bundled yarn as drawn by the take-up rollers 5.

Operation and advantages of the pneumatic twisting spinning apparatus thus constructed according to the present invention are as follows:

The blended sliver SL composed of 65% of polyester and 35% of cotton is gradually drafted by the drafting device 10 into a fleece S comprising a number of fibers having a cross section equal to the thickness of a yarn to be formed.

The fleece S as it leaves the front rollers 2 of the drafting device 10 is forced by the deflection roller 3 to change its direction of movement so as to be supplied along the curved surface AB on the outer peripheral wall of the front bottom roller 21. As a result, peripheral fibers of the fleece S are separated therefrom due to their inertia tending to move straightforwardly, centrifugal forces generated when the fleece moves along the curved surface AB, the rigidity of the fibers, and the curvature of the curved surface AB, and serve as free fibers FS. Since the fleece on the curved surface AB is subjected to little twisting caused by the pneumatic twisting nozzle 4, the peripheral fibers are relatively easily caused to come off the fleece. The free fibers FS have one ends free and the other ends held in the twisted main fibers. Although the free fibers FS are somewhat twisted by the pneumatic twisting nozzle, they are not sufficiently twisted as they are released, and hence the number of twists given to the free fibers differs from the number of twists given to the main fibers.

The fleece S as it departs from the curved surface AB of the front bottom roller 21 is supplied onto the deflection roller 3 across the clearance e (e=0.2 in the illustrated embodiment). The fleece S is then fed along the curved surface BC on the outer peripheral wall of the deflection roller 3, and free fibers FS are additionally formed in the same manner as when the fleece is fed along the curved surface AB of the front bottom wall 21.

The fleece S with the free fibers FS thus produced is rotated at a high speed by a swirling air stream flowing at a high speed in the twisting tube 41 of the pneumatic twisting nozzle 4. The fleece S is then given a twist opposite to that applied thereto upstream of the nozzle, so that the main fibers as twisted upstream of the nozzle become untwisted. The free fibers as slightly twisted are given an opposite twist corresponding to the difference between the numbers of twists of the main and free fibers, and are wound around the main fibers as now untwisted thereby forming a bundled yarn T.

The bundled yarn T thus produced is withdrawn by the take-up rollers 5 from the pneumatic twisting nozzle 4 and wound up by the winding rollers 6.

As is apparent from the foregoing, the pneumatic twisting spinning apparatus according to the present invention is advantageous in that the fleece is caused by the deflection roller 3 to be fed along the curved surfaces of the front bottom roller 21 and the deflection roller 3 so as to produce more free fibers than would be possible with conventional apparatus.

With the fleece supplied along the two substantially continuous curved surfaces of the front bottom roller 21 and the deflection roller 3, that is, through two turning points, little twisting and ballooning is transmitted from the pneumatic twisting nozzle, and hence more free fibers are produced.

The pneumatic twisting spinning apparatus according to the illustrated embodiment is also advantageous in that since many free fibers are produced and the curved surfaces AB and BC are shorter than fibers of the fleece, strong and good bundled yarns can be formed in which the free fibers with one ends tucked securely in the main fibers are wound around the latter. The bundled yarn can be spun at a speed of 50 m/min. –120 m/ min., and a single yarn thereof has a strength of 200 g or more.

The apparatus can spin strong and good bundled yarns, and hence can produce such yarns at high speeds and at increased rates of production.

Because the fleece is fed along the two substantially continuous curved surfaces AB and BC, or through two turning points, the fleece on the curved surfaces AB and BC is less subjected to a tension transmitted in the direction of withdrawal from the pneumatic twisting nozzle 4 and the take-up rollers 5, and hence the fleece is prevented from being broken or pulled off under such a tension. With the curved surfaces AB and BC shorter than the fibers of the fleece, a bundled yarn produced is prevented from being broken and can be spun stably at a high speed of 120 m/min. or higher.

The apparatus according to the illustrated embodiment can produce spun yarns effectively at high speeds and at high production rates and hence require a reduced amount of power. Since the deflection roller is driven by the front bottom roller 21, a mechanism required is simple, durable and can be serviced with ease.

Briefly summarized, the pneumatic twisting spinning apparatus according to the present invention includes a deflection roller for spinning strong and good bundled yarns stably at high speeds and at high rates or production, the deflection roller being durable without requiring much maintenance work.

The lengths $l_{AB}$, $l_{BC}$, $l_{AC}$ of the curved surfaces AB and BC on the outer peripheral walls of the front bottom roller and the deflection roller should be selected within the foregoing numerical ranges for best results taking into consideration the kind of sliver used, the length of fibers, the yarn number count, the surface properties such as fluffy, the curvatures and peripheral speeds of the rollers, and the like.

Figure 7A:
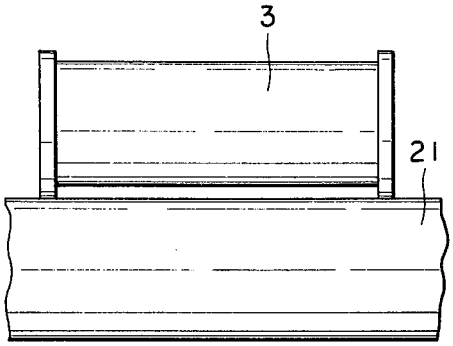
FIGS. 7(A), 7(B) and 7(C) are views illustrating modified deflection rollers.
Figure 7B:
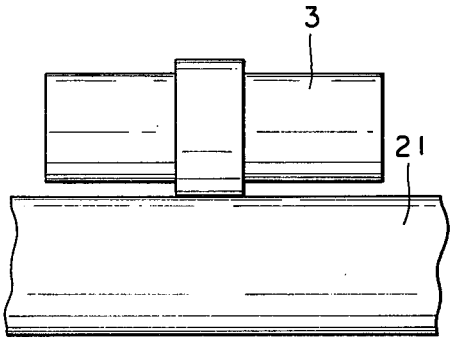
Figure 7C:
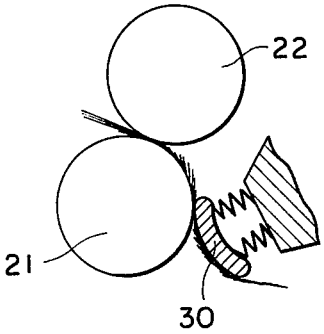

As shown in FIG. 7(A), a deflection roller 3 may have ends held in contact with a front bottom roller 21 and may be recessed where a fleece passes. In FIG. 7(B), a modified deflection roller 3 has a central portion held against a front bottom roller 21 and smaller-diameter ends. As illustrated in FIG. 7(C), the deflection roller 3 may be replaced with a support member 30 which is resiliently supported and has a curved surface against which a fleece is held, the support member 30 being disposed adjacent to a front bottom roller 21. Since the support member 30 does not rotate, it is less advantageous than deflection rollers.

While the sliver used in the illustrated embodiment is composed of polyester and cotton, sliver of 100% of synthetic fibers such as of polyester or an acryl, or sliver of 100% of cotton may also be used.

Obviously, numerous modifications and variations of the present invention are possible in the light of the above teachings. It is therefore to be understood that within the scope of the appended claims, the invention may be practiced otherwise than as specifically described herein. pg,29

What is claimed as new and desired to be secured by Letters Patent of the United States is:

1. A pneumatic twisting spinning apparatus comprising:

a drafting device having a front roller and back roller, each of said front and back rollers having a peripheral wall for opening fibers and forming bundled fibers having a predetermined thickness;

a deflection means, disposed adjacent to said front roller and spaced from said front roller by a predetermined distance, for varying the direction of fleece travel and supplying the fleece along an outer peripheral wall of said front roller, said deflection means having a contact surface and being positioned and constructed such that fleece which has been supplied along said outer peripheral wall of said front roller subsequently contacts a predetermined length of said contact surface;

a pneumatic twisting nozzle for injecting air under pressure into a twisting tube to form a swirling air stream having an axial component of force, so that the fleece supplied from said deflection means can be twisted into a yarn by the swirling air stream revolving at a high speed;

a take-up roller for withdrawing the yarn from said pneumatic twisting nozzle; and a winding roller for winding the yarn as it is withdrawn by said withdrawal roller, whereby ends of the peripheral fibers are separated from said fleece on said outer peripheral wall of said front roller and said contact surface of said deflection means, said peripheral fibers being twisted by said pneumatic twisting nozzle so as to be wound around central main fibers and forming a bundled yarn.

2. A pneumatic twisting spinning apparatus according to claim 1, wherein said deflection means comprises a deflection roller disposed adjacent to said front roller and drivable to rotate at a peripheral speed which is substantially the same as that of said front roller.

3. A pneumatic twisting spinning apparatus according to claim 2, wherein the length of said outer peripheral wall of said front roller along which said fleece is supplied is at least 5 mm and less than the length of fibers of said fleece supplied.

4. A pneumatic twisting spinning apparatus according to claim 2, wherein the length of said outer peripheral wall of said deflection roller along which said fleece is supplied is at least 1 mm and less than the length of fibers of said fleece supplied.

5. A pneumatic twisting spinning apparatus according to claim 2, wherein the combined length of said outer peripheral wall of said front roller and said deflection roller along which the fleece is supplied is at least 6 mm and less than the length of fibers of said fleece supplied.

6. A pneumatic twisting spinning apparatus according to claim 2, wherein the length $l_{AB}$ of said outer periphral wall of said front roller along which said fleece is supplied has the following characteristic:

$$2\pi rn < l_{AB} < L,$$

where r is the radius of said fleece, n is the number of turns of said peripheral fibers around the main fibers, and L is the length of fibers of the fleece.

7. A pneumatic twisting spinning apparatus according to claim 2, wherein the length $l_{AB}$ of said outer peripheral wall of said front roller along which said fleece is supplied is 0.4 L, where L is the length of fibers of the fleece.

8. A pneumatic twisting spinning apparatus according to claim 2, wherein the length $l_{BC}$ of said outer peripheral wall of said deflection roller along which said fleece is supplied is $\frac{1}{3}$ L, where L is the length of fibers of the fleece.

9. A pneumatic twisting spinning apparatus according to claim 2, wherein said deflection roller comprises roller having projections positioned at both ends thereof and held in contact with a front bottom roller, whereby the fleece passes within a recess formed between said annular projections.

10. A pneumatic twisting spinning apparatus according to claim 2, wherein;

said deflection roller comprises roller having an annular projection positioned at central portion thereof and held in contact with a front bottom roller, whereby the fleece passes within recesses formed by said annular projection.

11. A pneumatic twisting spinning apparatus according to claim 1, wherein said deflection means comprises support member having a resiliently supported curved surface, thereby holding the fleece and varying the supplied direction of the fleece.

* * * * *